US007548026B2

(12) United States Patent
Kuwahara et al.

(10) Patent No.: US 7,548,026 B2
(45) Date of Patent: Jun. 16, 2009

(54) MAGNETRON

(75) Inventors: Nagisa Kuwahara, Tochigi (JP); Masayuki Aiga, Tochigi (JP); Takeshi Ishii, Tochigi (JP)

(73) Assignee: Panasonic Corporation, Osaka (JP)

( * ) Notice: Subject to any disclaimer, the term of this patent is extended or adjusted under 35 U.S.C. 154(b) by 269 days.

(21) Appl. No.: 11/031,340

(22) Filed: Jan. 10, 2005

(65) Prior Publication Data

US 2005/0167426 A1 Aug. 4, 2005

(30) Foreign Application Priority Data

Jan. 9, 2004 (JP) ..... P. 2004-004201

(51) Int. Cl.
*H01J 25/50* (2006.01)

(52) U.S. Cl. ..... 315/39.51; 315/39.67; 315/39.69

(58) Field of Classification Search ..... 315/39.51, 315/39.53, 39.75, 39.55, 39, 39.61, 39.63, 315/39.67, 39.69; 219/385, 391, 678
See application file for complete search history.

(56) References Cited

U.S. PATENT DOCUMENTS 4,644,225 A * 2/1987 Aiga et al. ..... 315/39.51
5,146,136 A * 9/1992 Ogura et al. ..... 315/39.69
5,350,905 A * 9/1994 Choi ..... 219/761
5,798,613 A * 8/1998 Lee ..... 315/39.51
6,384,537 B2 * 5/2002 Whyman ..... 315/39.53
6,653,788 B2 * 11/2003 Ogura et al. ..... 315/39.51

FOREIGN PATENT DOCUMENTS

| | | |
|---|---|---|
| JP | 60-127638 | 7/1985 |
| JP | 11-233036 | 8/1999 |
| JP | 2003-045350 | 2/2003 |
| JP | 2003-331744 | 11/2003 |
| JP | 2003-331745 | 11/2003 |

OTHER PUBLICATIONS

Japanese Office Action, with English Translation, issued in Japanese Patent Application No. 2004-004201, dated on Jan. 9, 2008.
"Microwave Vacuum Tube", Dec. 1956, pp. 161-178, Wireless Technology Industry Employee Training Association.
Japanese Office Action, with English Translation, issued in Japanese Patent Application No. JP 2004-004201, dated Apr. 2, 2008.

* cited by examiner

*Primary Examiner*—Douglas W Owens
*Assistant Examiner*—Jimmy T Vu
(74) *Attorney, Agent, or Firm*—McDermott Will & Emery LLP

(57) ABSTRACT

For an anode assembly 51 of a magnetron, a plurality of plate shaped vanes 54 radially arranged at an inner circumference of the roughly round shaped anode assembly 53 has a end portion arranged at a central axis of the anode assembly 53 with a step shape Df having a reduced thickness in a range of predetermined length L from an end portion, so that increase of the facing area of the respective adjacent plate shaped vanes 54 is suppressed while the separation distance of the end portions of the vanes is secured.

2 Claims, 6 Drawing Sheets

FIG. 7 (a) PRIOR ART

FIG. 7 (b) PRIOR ART

FIG. 8 (a) PRIOR ART
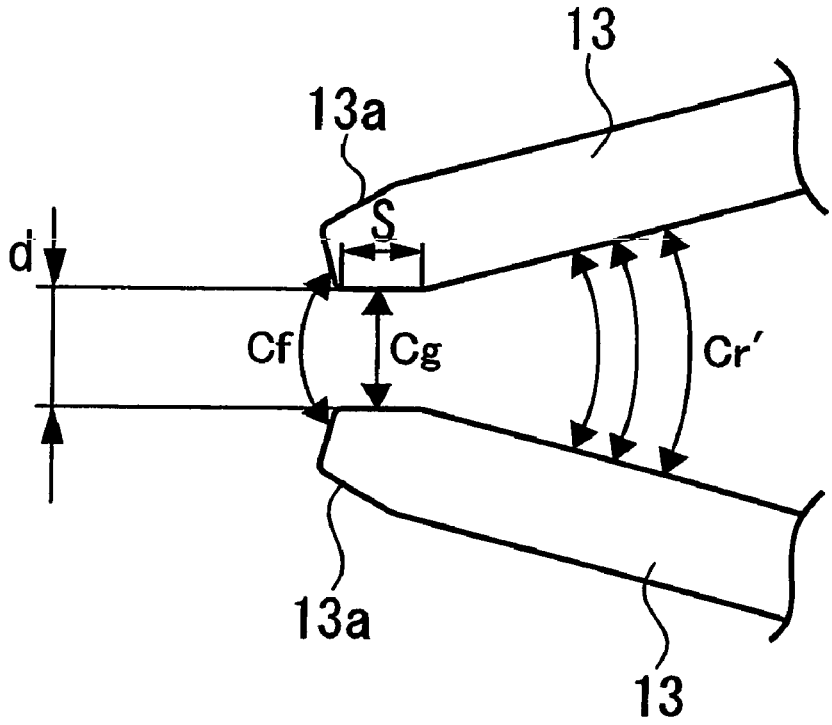
FIG. 8 (b) PRIOR ART
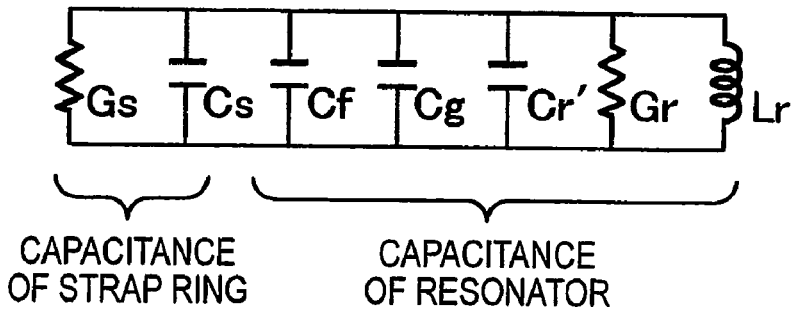

MAGNETRON

BACKGROUND OF THE INVENTION

The present invention relates to a magnetron for use in a microwave application apparatus such as an electronic oven.

In general, as shown in FIG. 5, a magnetron built into an electronic oven as a microwave oscillation device comprises a vacuum tube unit 1 arranged at a center, a plurality of radiating fins 2 arranged at a circumference of the vacuum tub unit 1, a pair of annular magnets 3 arranged concentrically to the vacuum tube unit 1, frame shaped yokes 4 and 5 for magnetically connecting the annular magnets 3, and a filter circuit unit 7. In addition, the vacuum tube unit 1 comprises an anode assembly 11, and a cathode assembly 21 built on the central axis of the anode assembly 11.

The anode assembly 11 comprises a substantially cylindrical anode tube body 12, an even number (N) of plate shaped vanes fixedly mounted on the anode tube body and radially from an inner circumference of the anode tube body 12 to a central axis to be spaced apart from an cathode assembly 21, two large and small strap rings 15 and 16 arranged at an end of a tube axis direction of the pate shaped vanes 13 for alternatively connecting for the respective plate shape vanes 13 for electrical short, and an antenna 17 connected to the plate vanes for outputting microwave, as shown in FIGS. 6 and 7.

In addition, the cathode assembly 21 a coil shaped filament 22 arranged at the center thereof, and end parts 23 and 24 connected to both ends of the filament 22, and a cathode supporting lid 25 connected to the filament 22 through these end parts 23 and 24, as shown in FIG. 5 (for example, see Patent Document 1).

The magnetron as mentioned above applies heat on the filament 22, and applies a high DC voltage between the filament 22 and the plate shaped vanes 13. Therefore, electrons radiated from the filament 22 to the plate shaped vanes 13 receives the effect of electromagnetic field that perpendiculars to a operational space 31 between the plate shapes vanes 123 and the filament 22, rotates around the filament 22, faces the plate shaped vanes 13 of the anode assembly 11, and produces an interaction with a minute microwave generated in a cavity resonator 33 divided by the even number of plate shaped vanes 13. Thus, a large microwave is generated in the cavity resonator 33 to output the generated microwave from the antenna 17.

A frequency of the microwave generated in the cavity resonator 33 is determined by an inductance L consisting of an inner circumferential wall of the anode tube body that forms the cavity resonator 33 and facing plate shaped vanes 13, and a capacitance C in combination with a capacitance Cr of the cavity resonator 33 consisting of the interrelated plate shaped vanes 13 and the anode assembly 12, and a capacitance Cs consisting of facing portions of the plate shaped vanes 13 and the strap rings 15 and 16. In general, the resonating frequency fr is represented as the following equation.

$$f_r=1/\{2\pi(LC)^{1/2}\} \quad (1)$$

The frequency is oscillated most strong and stably among the magnetron oscillation types and becomes a so-called π mode oscillation frequency of an inverse phase between the adjacent cavity resonators, and a main function of two large and small strap rings 15 and 16 that alternatively connect the plate shaped vanes 13 to make an electrical short-circuit is to maintain the stability of the π mode oscillation.

However, in the magnetron, N cavity resonators divided by N plate shaped vanes 13 are electrically coupled between each other, so that when the plate shaped vanes 13 are electrically short-circuited by the two large and small strap rings 15 and 16 alternatively, the oscillation with N/2 of different frequencies is performed.

For example, when the number N of plate vanes 13 is 10 so that the number of the cavity resonators 33 divided by the plate shaped vanes 13 is 10, a fundamental mode has 5 oscillation modes from N/2, which represent N/2 mode, N/2-1 mode, N/2-2 mode, N/2-3 mode and N/2-4 mode, referred to as "the π mode".

Therefore, in the π mode, oscillation can be made most strongly and stably under the operation conditions such as the frequency and the anode voltage. However, oscillation frequency in the N/2-1 mode adjacent to the π mode is close to the π mode oscillation frequency, so that even when the operation condition is changed very little, the oscillation is made from the π mode to N/2-1 mode, leading to an unstable phenomenon such as a mode jump.

Therefore, in order to set N/2-1 mode oscillation frequency apart from the π mode oscillation frequency, a ratio of capacitance Cr of the cavity resonator 33 formed by the respective plane shaped vanes 13 and the anode tube body 12 to capacitance Cs of the strap rings made of facing portions of the respective strap rings 15 and 16 and of the plate shaped panels is set to be large. But, a method in which the strap rings 15 and 16 are not all arranged in symmetry and a portion thereof is disconnected is proposed (for example, see pp. 163 to 166 of non-Patent Document 1).

In addition, to respond to the recently worldwide request for energy saving, there is a strong need of a highly efficient magnetron.

To achieve the highly efficient magnetron, high magnetic field, the number of split anodes and the small diameter of the anode and cathode are required, the distance between any two of the plate shaped vanes 13 becomes short (see pp. 172 to 177 of the afore-mentioned non-Patent Document 1).

Therefore, even when the distances of arrangement between the plate shaped vanes 13 with each other become short, a method of forming tapered surfaces 13*a* at both sides of the end portions of the respective plate shaped vanes 13 was proposed, as shown in FIG. 8, in order to secure a predetermined separation distance between the adjacent plate shaped vanes 13 (for example, see Patent Document 2).

[Patent Document 1] Japanese Patent Laid-Open No. 11-233036

[Patent Document 1] Japanese Patent Laid-Open No. 60-127638

[Non-Patent Document 1] 'Microwave Vacuum Tube' published by wireless technology industry Employee Training Association on December 1956.

Therefore, the capacitance Cr of the cavity resonator 33 consisting of the adjacent plate shaped vanes 13 and the anode tube body 12 is approximately determined by the capacitance Cg of end portions of the respective plate shaped vanes 13 which is closest to each other. Thus, as shown in FIG. 8(*a*), when the facing area of the end portions of the respective plate shaped vane 13 which are closest to each other is S, and the distance between the facing surface is d, Cr can be represented as the following equation 2.

$$Cr \approx Cg = \epsilon \times S/d \quad (2)$$

Thus, according to the construction where the taper surface 13*a* is arranged at both sides of the end portions of the respective plate shaped vanes 13 as described above, in fact, such a large separation distance cannot be secured. As a result, the capacitance Cr of the cavity resonator 3 becomes large.

Further, FIG. 8(*b*) shows an equivalent circuit diagram of FIG. 8(*a*).

To secure a predetermined value of a composition capacitance C based on the above equation 1, the capacitance Cr of the resonant cavity 33 should be large and a ratio of the capacitance Cs of the strap rings should be small.

As a result, a ratio of the capacitance Cs to the capacitance Cr is determined to be large so that the N/2-1 mode oscillation frequency is set apart from the π mode oscillation frequency, leading to a problem on instability for the operation condition due to any of the mode jumps. Furthermore, it is difficult to achieve both the high efficiency and the stable operation.

In addition, to guarantee a large separation distance between the plate shaped vanes 13, the respective vanes may be formed to have small thickness. However, as the thickness is small, it will not have a heat capacity as a magnetron.

SUMMARY OF THE INVENTION

Here, an object of the present invention is to solve the afore-mentioned problems, and thus, even when the distance between the respective plate shaped vanes is formed narrow for high efficiency, N/2-1 mode oscillation frequency can be set apart from the π mode by making large a ratio of the capacitance Cs of the strap rings to the capacitance Cr of the cavity resonator divided by the respective plate shaped vanes. Therefore, even when the operation condition is barely changed, a mode jump due to a close arrangement between the N/2-1 mode and the π mode can be prevented, so that a magnetron having both high efficient and stable operation characteristics can be provided.

The above object can be accomplished through the following constructions.

(1) A magnetron comprises an anode assembly having a approximately cylindrical anode tube body, an even number of plate shaped vanes fixedly mounted to an inner circumference of the anode tube body and radially arranged from the inner circumference of the anode tube body to a central axis, and large and small strap rings for electrically connecting the plate shaped vanes to each other; and a cathode assembly inserted on the central axis of the anode assembly, wherein an end portion of each plate shaped vane positioned on the central axis of the anode tube body is formed in a step shape whose thickness in a range of a predetermined length L from the end thereof is smaller than other portion.

(2) In the magnetron according to the above (1), when a plate thickness of the base substrate of the plate shaped vanes is $t_0$, the thickness of the end portion which is thinned in a step shape is $t_1$, a distance between ends of adjacent plate shaped vanes is w, and the number of the plate shaped vanes is N, N, L, $t_0$ and $t_1$ satisfy the following equations:

$$w/(t_1+w)\leqq 0.5$$

$$L\geqq\{(t_{0-t1})/2\}\div\tan(180/N).$$

According to the magnetron described above (1), even when the distance between the respective plate shaped vanes is small for high efficiency, since the end portions of the adjacent plate shaped vanes is a step type, the distance between the facing surfaces of the respective plate shaped vanes is gradually broaden and compared to the prior art where the end portion has a tapered surface, for the respective plate shaped vanes, increase of the area that faces with a narrow gap will be suppressed.

Therefore, the capacitance Cr of the cavity resonator affected by the facing area of the end portions of the respective adjacent plate shaped vanes and the separation distance between the facing surfaces can be prevented from being small. As a result, a ratio of the capacitance Cr of the cavity resonator divided by the respective adjacent plate shaped vanes to the capacitance Cs of the strap rings can be set to be large, so that N/2-1 mode oscillation frequency can be set apart from the π mode oscillation frequency. In addition, a degree of separation of the unstable adjacent mode can be made large.

Therefore, even when the operation condition is barely changed, the mode jump due to the close arrangement between the N/2-1 mode and the π mode can be prevented. Furthermore, the π mode having high efficiency can be maintained most stably, and both high efficiency and the operation stability can be achieved at the same time.

Further, with the magnetron described above (2), N, L, $t_0$ and $t_1$ can be determined such that oscillation efficiency can be maintained, for example, more than 70%. Thus, the end portions of the plate shaped vanes can be prevented from being excessively thin, and decrease in a thermal durability of the end portion of the vane can be prevented.

BRIEF DESCRIPTION OF THE DRAWINGS

FIG. 7(*a*) is a cross sectional view of the anode assembly of the magnetron shown in FIG. 5, and FIG. 7(*b*) is a plan view of FIG. 7(*a*);

FIG. 8(*a*) is an enlarged diagram showing a conventional measure to maintain a separation distance of the end portion of the adjacent plate shaped vanes, and FIG. 8(*b*) is a diagram showing an equivalent circuit thereof

DETAILED DESCRIPTION OF THE PREFERRED EMBODIMENTS

Hereinafter, a magnetron according to exemplary embodiments of the present invention will be described in detail with reference to the attached drawings.

Figure 1:
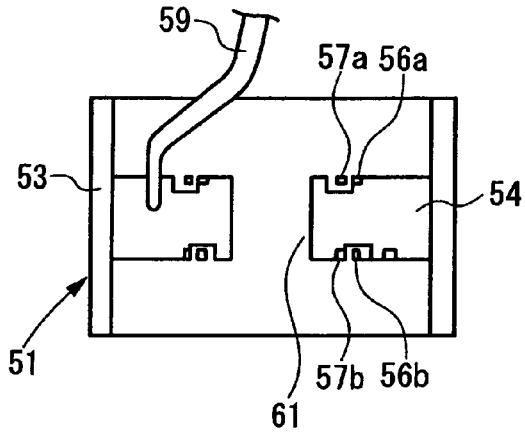
FIG. 1(*a*) is a cross sectional view of a magnetron according to an embodiment of the present invention, and FIG. 1(*b*) is a plan view of an anode assembly shown in FIG. 1(*a*)
Figure 1:
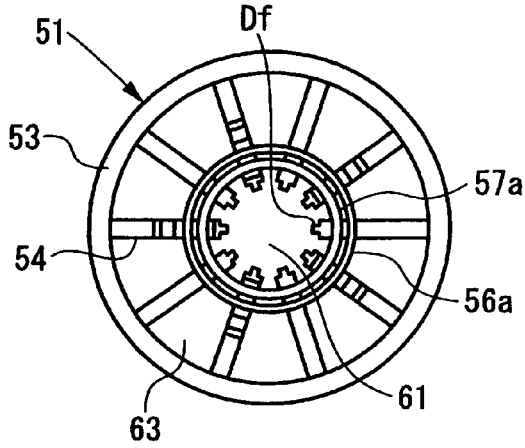

FIG. 1 shows an anode assembly according to an embodiment of the present invention for use in a magnetron, and FIG. 1(*a*) is a cross sectional view of the anode assembly and FIG. 1(*b*) is a plan view of the anode assembly shown in FIG. 1(*a*).

Figure 5:
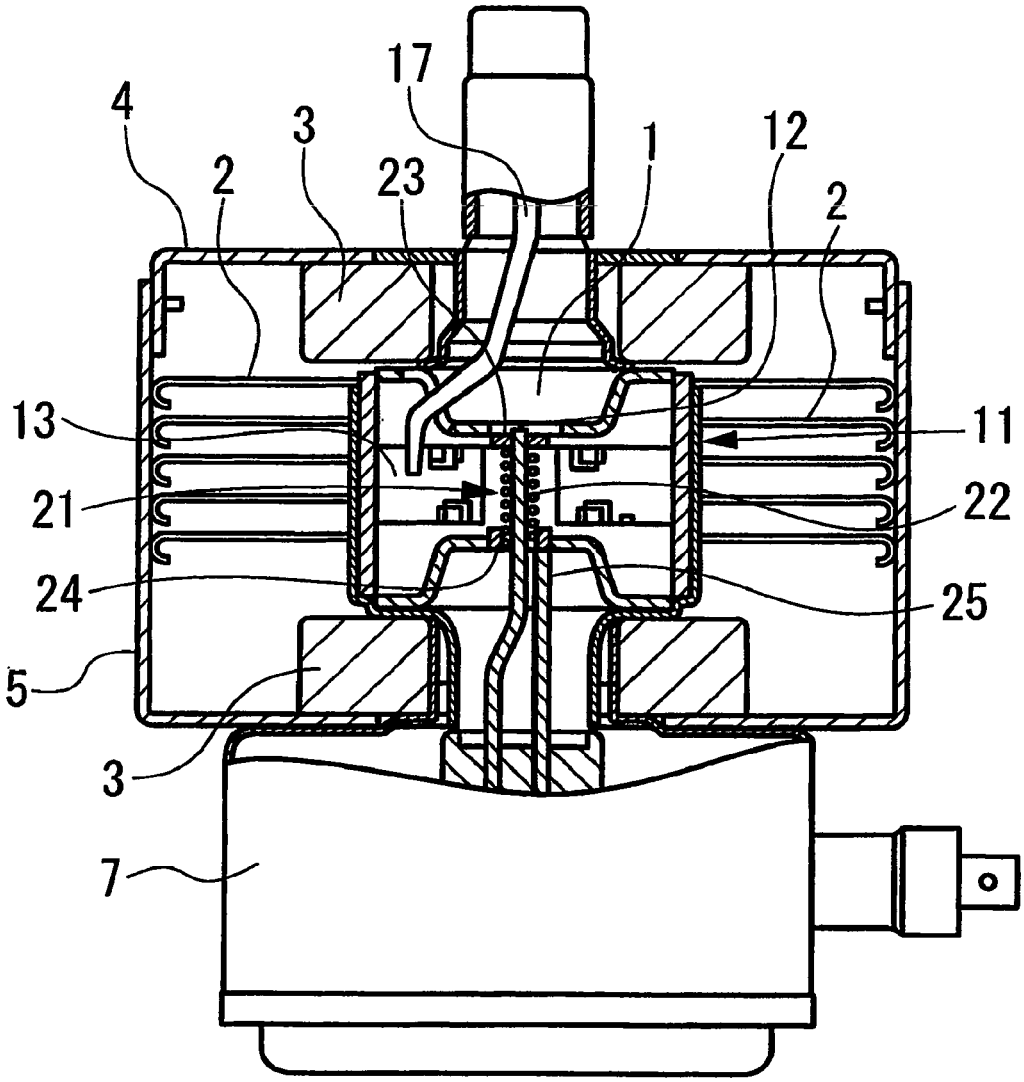
FIG. 5 PRIOR ART
FIG. 5 is a cross sectional view showing a rough construction of the conventional magnetron.
Figure 6:
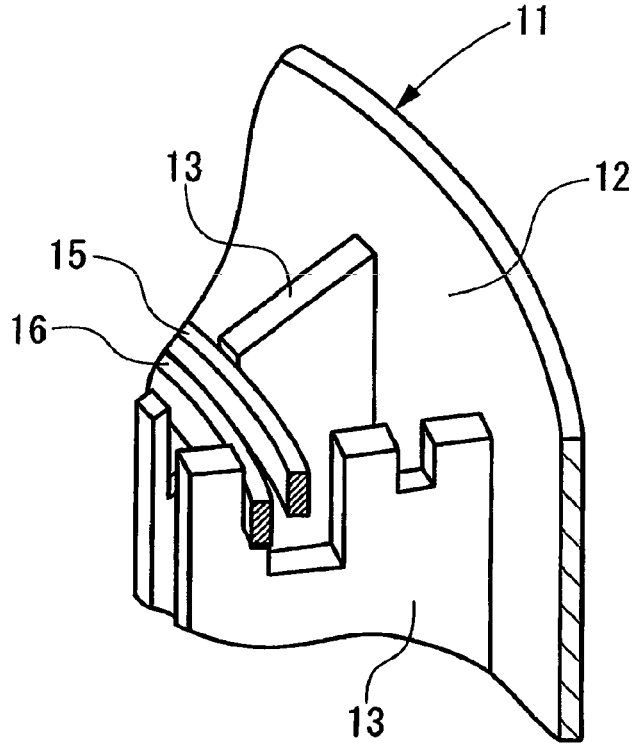
FIG. 6 PRIOR ART
FIG. 6 is a perspective view showing main parts of an anode assembly of the magnetron shown in FIG. 5.
Figure 6:
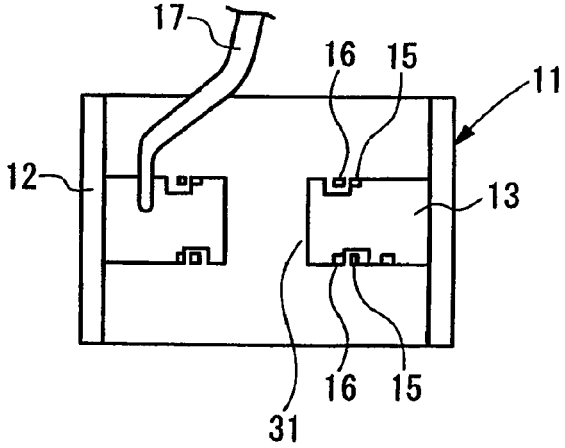
FIG. 6 PRIOR ART
Figure 6:
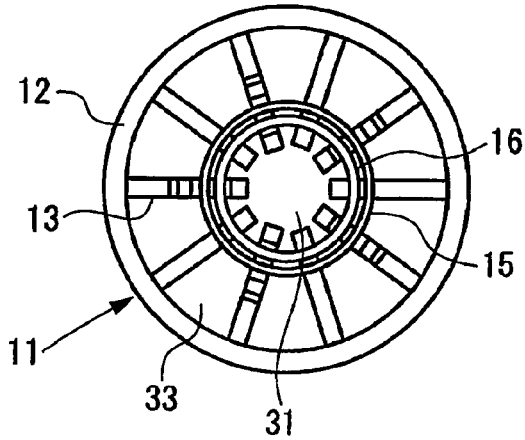
FIG. 6 PRIOR ART

The magnetron according to an embodiment of the present invention is a microwave oscillation tube that operates at a fundamental frequency of 5,800 MHz, and a cathode assembly is built in a central axis of the anode assembly 51. However, elements other than the anode assembly 51 such as the cathode assembly, radiating fins arranged at the outer circumference of the cathode assembly, an annular magnet, a frame shape yoke, a filter circuit unit, and so on have the same construction as the prior art shown in FIG. 5, so that the description of the elements having the same construction as the prior art will be omitted herein.

The anode assembly 51 according to an embodiment of the present invention comprises a substantially cylindrical anode tube body 53 having the cathode assembly built in the central axis, an even number of (N) plate shaped vanes 54 fixedly mounted on the given anode tube body radially arranged from the inner circumference of the anode tube body 53 to the central axis, large and small strap rings 56*a*, 56*b*, 57*a*, and 57*b* electrically and alternatively connecting these plate shaped vanes 54, and an antenna 59 connected to any one of the plate shaped vanes 54 for outputting an microwave.

According to an embodiment of the present invention, the number of plate shaped vanes 54 is 18, and using the 18 plate shaped vanes 54, 18 cavity resonators 63 are arranged in the circumference of the operational space 61 between the end portions of the respective plate shaped vanes 54 and the cathode assembly.

Figure 2:
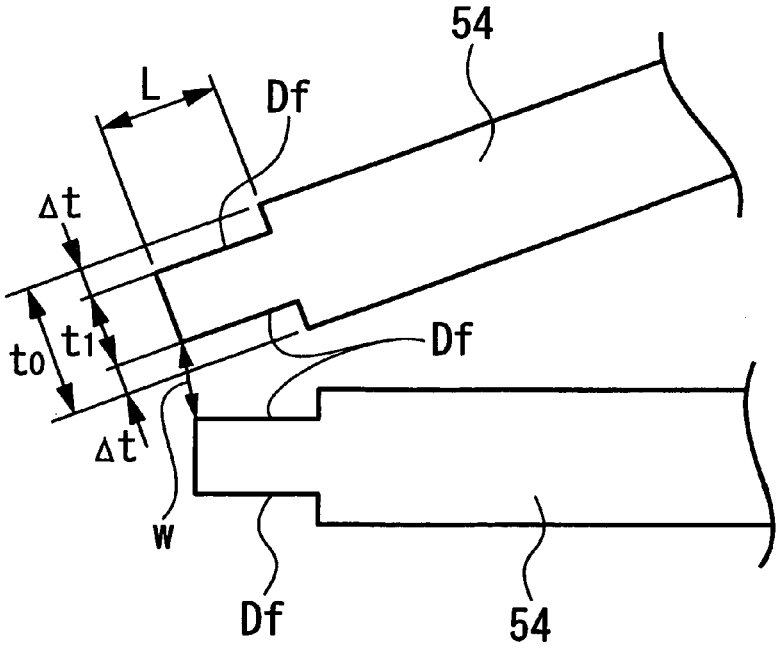
FIG. 2 is an enlarged diagram showing end portions of adjacent plate shaped vanes shown in FIG. 1.

Therefore, in the anode assembly 51 of the embodiment of the present invention, the end portions of the respective plate shaped vanes 54 arranged at the central axis of the anode tube body 53 has a step shape Df whose thickness is thinned by $\Delta t$ in a range of predetermined length (depth) L from the end, as shown in FIG. 2.

Further, for the plate shaped vanes 54 with a plate thickness of the base end of the plate shaped vanes is $t_0$, a plate thickness of the end portion whose both sides having step portions is thinned by $\Delta t$ is $t_1$, a separation distance between the end portions of the respective adjacent plate shaped vanes is w, and the number of the plate shaped vanes is N, N, L, $t_0$ and $t_1$ satisfy the following equations.

$$w/(t_1+w) \leqq 0.5 \quad (3)$$

$$L \geqq \{(t_0-t_1)/2\} \div \tan(180/N) \quad (4)$$

According to the magnetron of the present embodiment as described above, even when the distance between the respective plate shaped vanes 54 is reduced due to the high magnetic field for high efficiency, increase of the number of divided anodes, and small diameters of the anode and the cathode, the end portions of the respective adjacent plate shaped vanes 54 have step shape Df at both sides. Thus, a distance (separation distance) of the facing surface of the respective plate shaped vanes 54 is gradually broader, and compared to the prior art where the end portion is tapered, increase of area of a portion which the end portions of the respective plate shaped vanes 54 face to each other with a narrow gap can be prevented.

Therefore, decrease in the capacitance Cr of the cavity resonator 65 affected by the area facing end portions of the respective adjacent plate shaped vanes 54 and the separation distance between the facing surfaces can be prevented. As a result, by making large a ratio of the capacitance Cr of the cavity resonator 63 divided by the respective adjacent plate shaped vanes 54 to the capacitance Cs of a strap ring unit having the strap rings, 56*a*, 56*b*, 57*a*, and 57*b*, the modes are separated such that the N/2-1 mode oscillation frequency is set apart from the $\pi$ mode oscillation frequency. Thus, the unstable separation degree of the adjacent mode can be made large.

Therefore, even when the operation condition is barely changed, the mode jump due to the close arrangement between the N/2-1 mode and the $\pi$ mode can be prevented. In addition, the $\pi$ mode oscillation with high efficiency can be maintained most stably, and both high efficiency and operation stability can be achieved at the same time.

In addition, in the above equation 4, the length of L of the thin end portions of the plate shaped vanes 54 is determined to be in the above range, which means that, by exposing a corner which is a base end portion of the plate shaped vanes 54 and has the length of L so as to be seen from the cathode assembly, electrons at the corner are concentrated so that the distance between the vanes becomes large. Accordingly, the step shape Df becomes substantially negligible.

In addition, when N, L, $t_0$ and $t_1$ satisfy both the above equations 3 and 4, oscillation efficiency can be maintained, for example, more than 70%. Further, the end portions of the plate shaped vanes 54 can be prevented from being excessively thin, and thus, decrease in the thermal durability endurance of the end portions of the vanes can be prevented.

Figure 3:
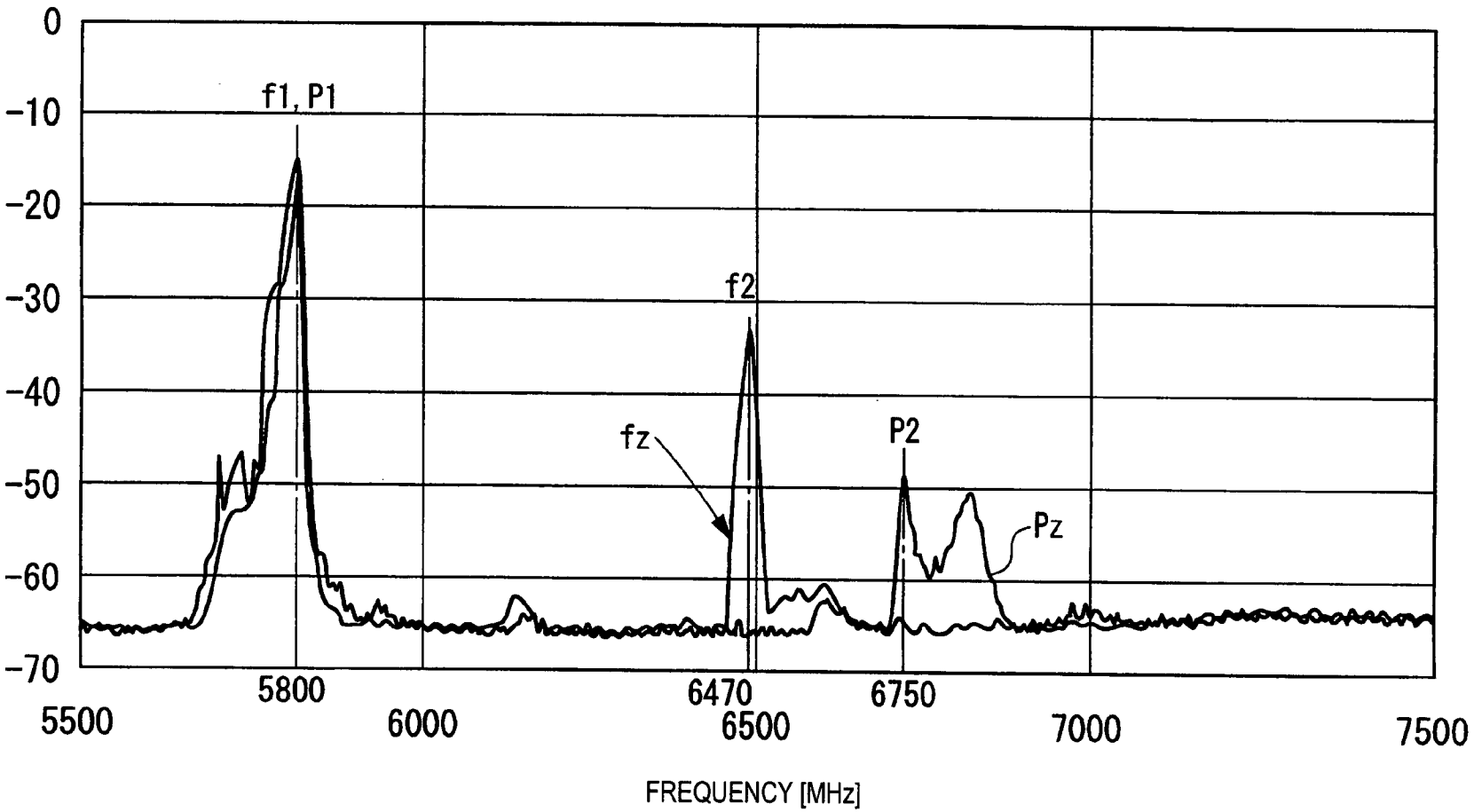
FIG. 3 is diagram for comparing a characteristic of a microwave oscillation by the magnetron of an embodiment shown in FIG. 1 to a characteristic of a microwave oscillation used in the conventional plate shaped vanes.

To confirm the effect of the embodiment of the present invention, in FIG. 3, a characteristic of a microwave oscillation frequency for the magnetron of the afore-mentioned embodiment and a characteristic of a microwave oscillation frequency for the conventional magnetron that uses the plate shaped vanes 13 shown in FIG. 8 instead of the above plate shaped vanes 13 are measured.

In FIG. 3, a characteristic curve fz corresponds to the conventional magnetron while a characteristic curve Pz corresponds to the magnetron according to an embodiment of the present invention.

From the characteristic curve fz of the conventional magnetron, a $\pi$ mode oscillation frequency f1 is located around 5,800 MHz while an N/2-1 mode oscillation frequency f2 is located around 6,470 MHz. Here, the N/2-1 mode is close to the $\pi$ mode.

However, from the characteristic curve Pz of an embodiment of the present invention, the $\pi$ mode oscillation frequency P1 is located around 5,800 MHz while the N/2-1 mode oscillation frequency P2 is located around 6,750 MHz. Thus, the N/2-1 mode is separated from the $\pi$ mode, and thus, mode separation is improved.

In addition, a peak level of the N/2-1 mode is also significantly reduced in the embodiment of the present invention, which makes a confirmation that it is difficult to make oscillation at other than the $\pi$ mode.

Figure 4:
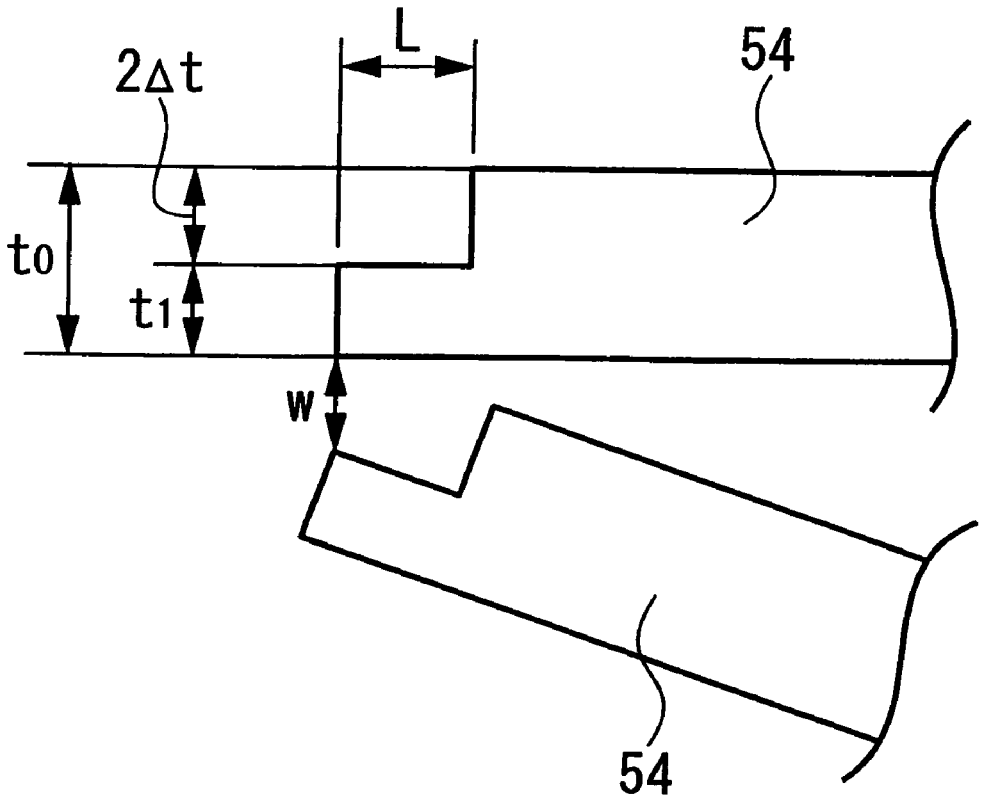
FIG. 4 is an enlarged diagram showing end portions of adjacent plate shaped vanes according to another embodiment of the present invention.

In addition, according to an embodiment of the present invention, the step shape Df is formed at both sides of the end portion of the respective plate shaped vanes 54, as shown in FIG. 2. Therefore, a separation distance d between the adjacent plate shaped vanes and a reduction of the approaching and facing area can be also implemented by forming the step shape Df at both sides of the ends of the plate shaped vanes 54, as shown in FIG. 4.

This application is based upon and claims the benefit of priority of Japanese Patent Application No. 2004-004201 filed on Jan. 9, 2004, the contents of which are incorporated herein by reference in its entirety.

What is claimed is:

1. A magnetron comprising:

an anode assembly having an approximately cylindrical anode tube body, an even number of plate shaped vanes fixedly mounted to an inner circumference of the anode tube body and radially arranged from the inner circumference of the anode tube body to a central axis, and large and small strap rings for electrically connecting the plate shaped vanes to each other; and a cathode assembly inserted on the central axis of the anode assembly, wherein an end portion of each plate shaped vane positioned on the central axis of the anode tube body is formed in a step shape whose thickness in a range of a predetermined length L from the end thereof is smaller than other portion, and wherein the step shape, when viewed in the direction of the central axis, creates a reduced thickness in the innermost portion of each plate shaped vane, wherein, when a plate thickness of the base substrate of the plate shaped vanes is t0, the thickness of the end portion which is thinned in a step shape is t1, a distance between ends of adjacent plate shaped vanes is w, and the number of the plate shaped vanes is N, and wherein N, L, t0 and t1 satisfy the following equations:

$$w/(t_1+w) \leqq 0.5$$

$$L \geqq \{(t_0-t_1)/2\}+\tan(180/N).$$

2. The magnetron according to claim 1, wherein each plate shaped vane has two steps formed symmetrically on opposite sides of the end portion of each plate shaped vane.

* * * * *